US005099191A

United States Patent [19]

Galler et al.

[11] Patent Number: 5,099,191

[45] Date of Patent: Mar. 24, 1992

[54] TUNNEL DIODE VOLTAGE REFERENCE CIRCUIT

[75] Inventors: Francis A. Galler, Nolfolk; Randall J. Pflueger, Cambridge, both of Mass.

[73] Assignee: The Charles Stark Draper Laboratory, Inc., Cambridge, Mass.

[21] Appl. No.: 609,391

[22] Filed: Nov. 5, 1990

[51] Int. Cl.[5] ..... G05F 3/16

[52] U.S. Cl. ..... 323/313; 323/229

[58] Field of Search ..... 323/311, 312, 313, 314, 323/229; 307/322-323

[56] References Cited

U.S. PATENT DOCUMENTS

| | | | |
|---|---|---|---|
| 3,325,726 | 6/1967 | McDaniel | 323/229 |
| 4,242,595 | 12/1980 | LeHovec | 307/322 |
| 4,785,230 | 11/1988 | Ovens et al. | 323/313 |
| 4,948,989 | 8/1990 | Spratt | 323/229 |

OTHER PUBLICATIONS

Kincaid, R., "Squaring Circuit Makes Efficient Frequency Doubler", EDN/EEE, v. 16 #16, Aug. 15, 1971, p. 45.

*Primary Examiner*—Peter S. Wong
*Attorney, Agent, or Firm*—Iandiorio & Dingman

[57] ABSTRACT

A tunnel diode voltage reference circuit includes a tunnel diode; bias voltage circuit for biasing the tunnel diode to operate in the region of the peak current where the tunnel diode output current variation is a fraction of the bias voltage variation; and circuits responsive to the tunnel diode output current, for isolating the tunnel diode output from load variations and converting the tunnel diode output to a reference voltage. A resistance may be placed in parallel with the tunnel diode for raising the negative resistance region to the levels of the peak region to flatten the slope of the negative resistance region between the peak and the valley regions, reducing the reference voltage variation at bias points greater than the peak voltage of the tunnel diode characteristic.

6 Claims, 3 Drawing Sheets

TUNNEL DIODE VOLTAGE REFERENCE CIRCUIT

FIELD OF INVENTION

This invention relates to a current stabilized tunnel diode voltage reference circuit.

BACKGROUND OF INVENTION

Present voltage reference circuits for use in radiation hard systems use either magnetic references or reverse biased semiconductor PN junction devices. Voltage references utilizing magnetic references are very large and sensitive to external magnetic fields. Voltage references utilizing PN junctions use fewer parts but shift much more in radiation. These junctions individually shift much more because their output is determined by a relatively low concentration of dopant atoms. As a result of neutron irradiation a large percentage of these dopant atoms are removed from the conduction band. A tunnel diode is a forward biased PN junction whose output is determined by a dopant concentration many orders of magnitude heavier than the typical reverse biased semiconductor reference. A much lower percentage of the dopant atoms is removed by radiation and the tunnel diode output changes a correspondingly much lower amount.

SUMMARY OF INVENTION

It is therefore an object of this invention to provide an improved, simpler precision voltage reference circuit.

It is a further object of this invention to provide such a voltage reference circuit which is radiation hard.

It is a further object of this invention to provide such a voltage reference circuit which employs a stabilized current source to obtain precision voltage reference.

It is a further object of this invention to provide such a voltage reference circuit which is more isolated from load variations and which provides higher precision voltage reference levels.

It is a further object of this invention to provide such a voltage reference circuit which is less sensitive to fluctuations in input voltage.

It is a further object of this invention to provide such a voltage reference circuit which reads out the current and converts that to the precision voltage reference.

The invention results from the realization that a simple, extremely effective precision voltage reference circuit can be constructed using a tunnel diode insensitive to input voltage fluctuations to produce a constant current output easily converted to a precision voltage reference output, and the further realization that a tunnel diode can be operated either proximate its positive current peak or in the negative resistance region close to the peak when that negative region has been adjusted to a flattened slope.

This invention features a tunnel diode voltage reference circuit including a tunnel diode and bias voltage means for biasing the tunnel diode to operate in the region of the peak current where the tunnel diode output current variation is a fraction of the bias voltage variation. There are means responsive to the tunnel diode output current for isolating the tunnel diode output from load variations and converting the tunnel diode output current to a reference voltage. The means for isolating and converting may include a transimpedance amplifier. The transimpedance amplifier may include an operational amplifier with a feedback impedance in parallel with it. The invention also features a tunnel diode reference circuit which includes a tunnel diode and a resistance in parallel with the tunnel diode for raising the valley region and the peak region of the tunnel diode conduction characteristic to the same levels and flattening the slope of the negative resistance region between the valley and peak regions. There are bias voltage means for biasing the tunnel diode to operate in the flattened negative resistance region where the tunnel diode output variation is a fraction of the bias voltage variation. Means responsive to the tunnel diode output current isolate the tunnel diode output from load variations and convert the tunnel diode output current to a reference voltage. The means for isolating may include a transimpedance amplifier which may be formed from an operational amplifier with a feedback impedance in parallel with it.

DISCLOSURE OF PREFERRED EMBODIMENT

Other objects, features and advantages will occur to those skilled in the art from the following description of a preferred embodiment and the accompanying drawings, in which.

In one construction the invention may be accomplished using a tunnel diode biased to operate in the positive peak region. The operating region is typically 1–3% on either side of the positive peak $V_p$. In this region the V/I curve is relatively flat: a 3000–4000 part per million (ppm) change in voltage results in only a 50 ppm change in current. Thus by biasing a tunnel diode in the area of its peak with a bias source which is stable to only 3000–4000 ppm a tunnel diode nevertheless may be used as a very precise current source. The tunnel diode current source can then be employed in a voltage reference by processing it in a circuit with a transimpedance amplifier. In addition, because tunnel diodes operating near their positive-going peaks are relatively insensitive to radiation effects, this circuit is also useful as a radiation hard voltage reference.

In a second construction, the tunnel diode can be used as a precision voltage reference by operating it in the negative resistance region closer to the positive peak, as opposed to the negative peak or valley region $V_N$. The region between the two peaks is the negative resistance region of the tunnel diode. By adding a parallel resistor the V/I curve for the tunnel diode is flattened out so that at least a portion of the negative resistance region and the positive peak are at approximately the same level. This makes the current output of the tunnel diode resistor circuit much more immune to bias voltage variations than the first construction.

Figure 1:
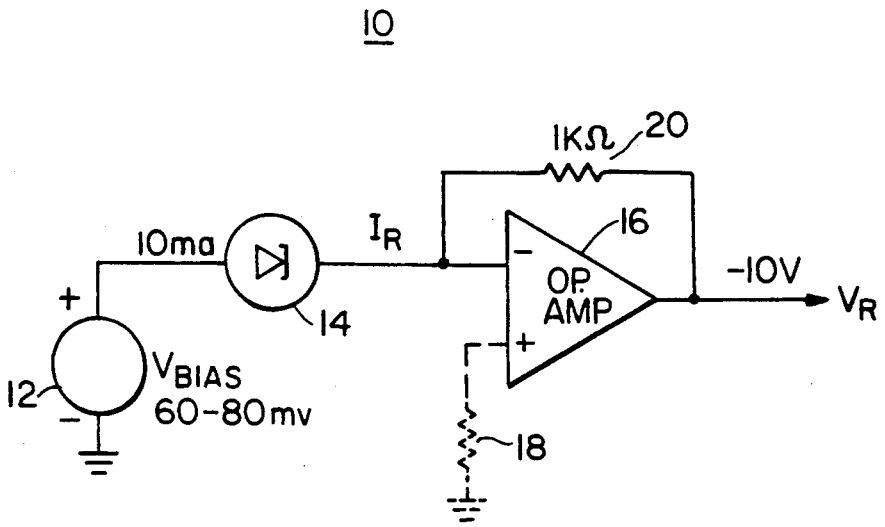
FIG. 1 is a specific example of a schematic diagram of a tunnel diode voltage reference circuit according to this invention.

There is shown in FIG. 1 a tunnel diode voltage reference circuit 10 according to this invention. A voltage bias source 12 provides a voltage which may range from 60–80 mv. This establishes a 10 ma current flow through tunnel diode 14 that is maintained constant sufficiently to be designated a reference current $I_R$. The reference current is fed directly into the negative input of operational amplifier 16, whose other, positive, input may be connected to a reference resistor 18. A feedback resistance 20 such as a 1000 ohm resistor causes operational amplifier 16 to perform as a transimpedance amplifier which provides at its output a −10 volt voltage, which is stabilized sufficiently to establish reference voltage $V_R$. If a positive $V_R$ is desired, tunnel diode 14 may be reversed from the position shown and the bias voltage from source 12 may be similarly reversed.

Figure 2:
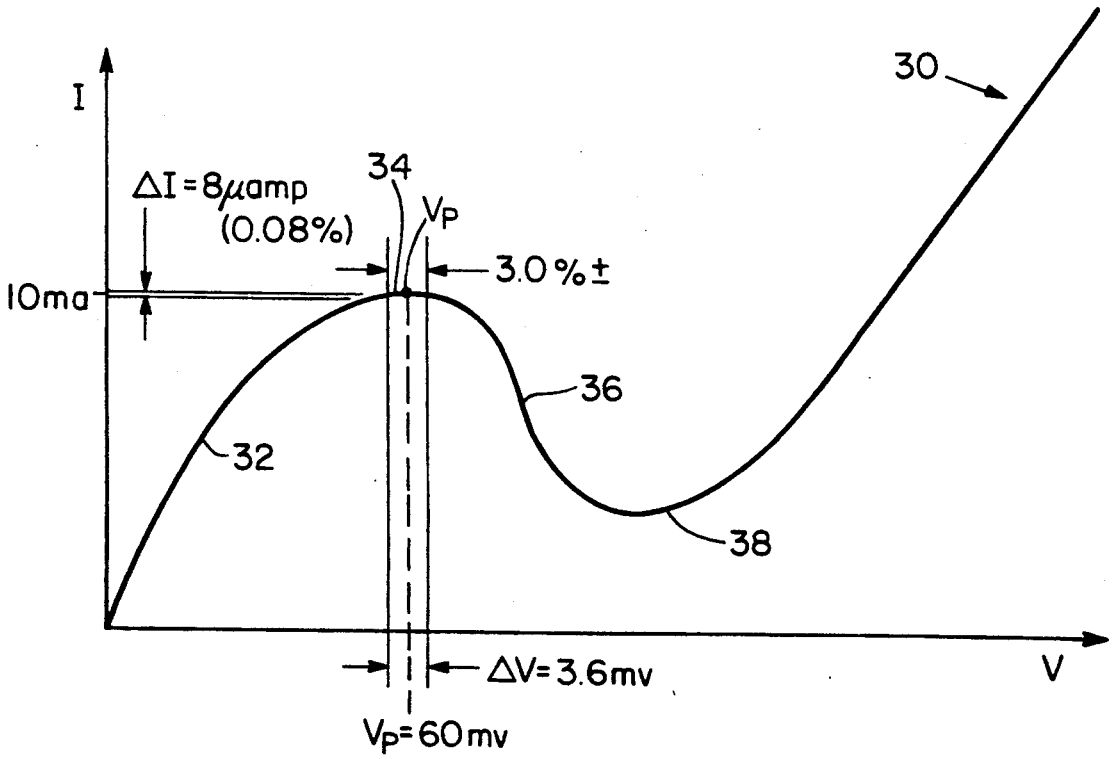
FIG. 2 is an illustration of the voltage/current characteristic of the tunnel diode of FIG. 1.
Figure 3:
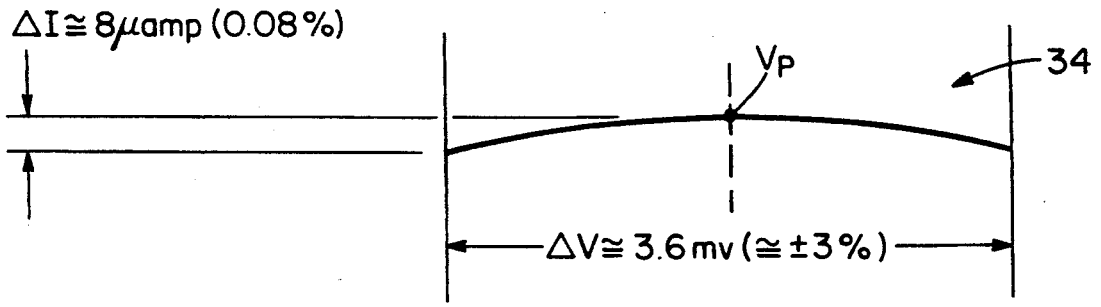
FIG. 3 is an enlarged view of the peak voltage area of the characteristic shown in FIG. 2.

The operation of circuit 10, FIG. 1, may be more readily understood with respect to the V/I characteristic 30 shown in FIG. 2. Characteristic 30 is a typical characteristic for a tunnel diode. It includes a first positive slope region 32 and a peak region 34, followed by negative resistance slope region 36 and valley region 38. Tunnel diode 14 operates at a peak voltage $V_P$ of approximately 60 mv, which may vary from 1–3% in either direction. This constitutes a variation in $V_P$, referred to as $\Delta V$, of approximately 3.6 mv. Because of the extremely flat profile of the curve in the peak region 34, FIG. 3, the current fluctuation around the 10 ma level referred to as $\Delta I$ is approximately 8 microamps, representing a percentage change of 0.089.

Figure 4:
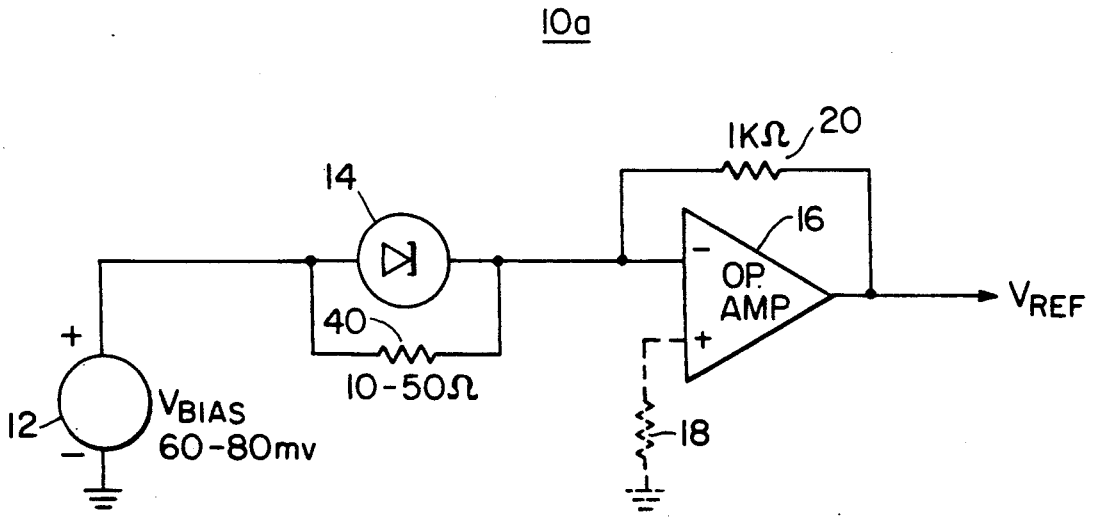
FIG. 4 is a specific example of a tunnel diode voltage reference circuit according to this invention with a resistor in parallel with the tunnel diode to flatten the negative resistance region.
Figure 5:
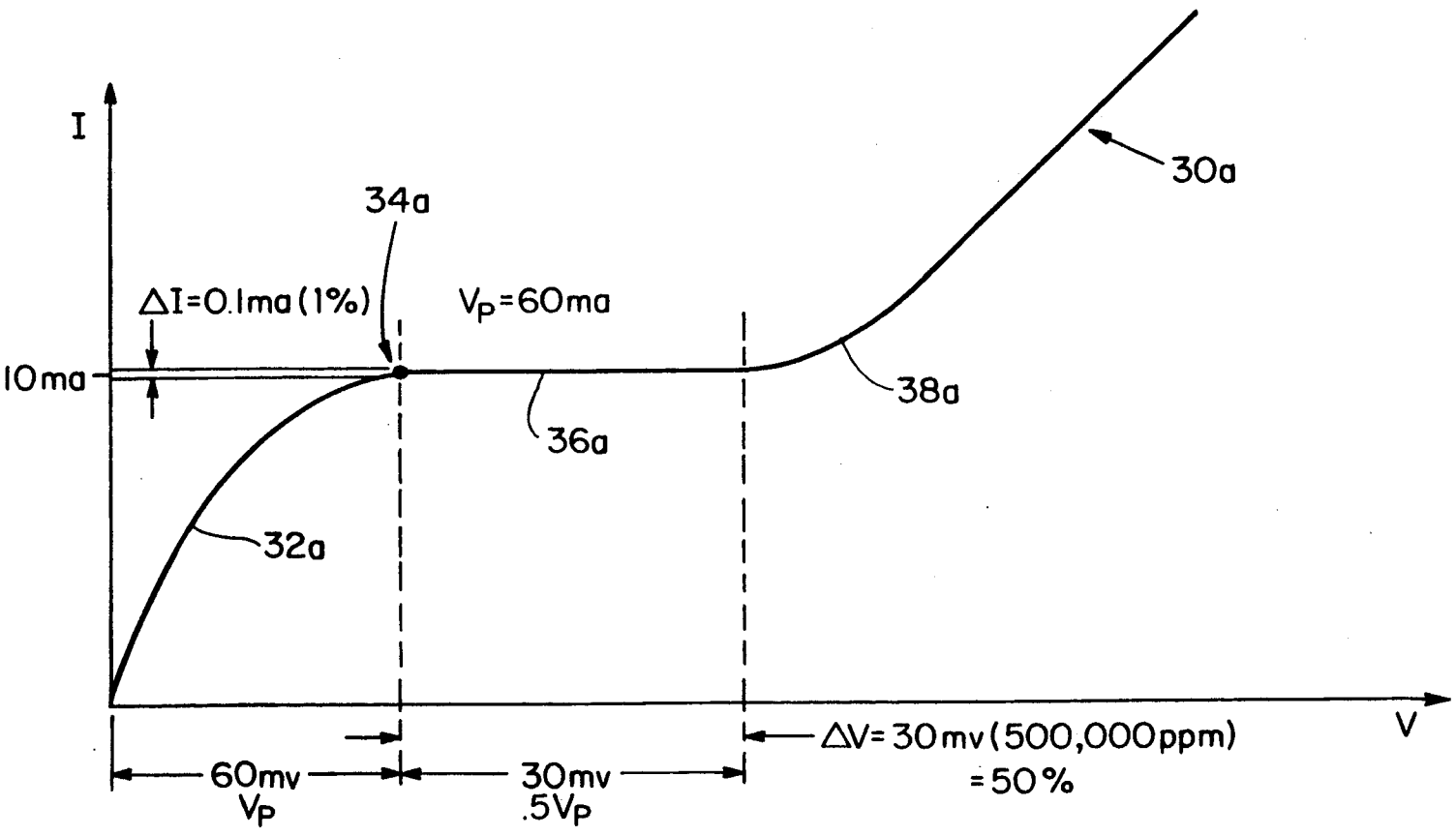
FIG. 5 is an illustration of the voltage current characteristic of the tunnel diode circuit of FIG. 4 showing the flattened negative resistance region.

Alternatively, tunnel diode voltage reference circuit 10*a*, FIG. 4, may include a parallel resistor 40 connected across tunnel diode 14. This raises the level of the negative resistance region 36*a*, FIG. 5, so that it is flattened and generally on a plane with the peak region 34*a* and the peak voltage $V_P$. The flattened negative region 36*a* may extend up to 50% greater than $V_P$ so that $\Delta V$ may now approach 30 mv for a peak voltage $V_P$ of 60 mv. Under these conditions, with a 10 ma current $\Delta I$ may reach 0.1 ma, representing a 1% variation, thereby providing an excellent precision voltage reference circuit which is additionally radiation hard.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A tunnel diode voltage reference circuit, comprising:

a tunnel diode having a conduction characteristic;

bias voltage means for producing a tunnel diode output current and for biasing said diode to operate in a specific region of the conduction characteristic where the output current varies as a fraction of a variation in the bias voltage;

means, responsive to the tunnel diode output current, for isolating the tunnel diode output from load variations and for converting the tunnel diode output current to a reference voltage.

2. The tunnel diode voltage reference circuit of claim 1 in which said means for isolating and converting includes a transimpedance amplifier.

3. The tunnel diode voltage reference circuit of claim 2 in which said transimpedance amplifier includes an operational amplifier and a feedback impedance in parallel therewith.

4. A tunnel diode voltage reference circuit, comprising:

a tunnel diode having a conduction characteristic;

a resistance in parallel with said tunnel diode for modifying the conduction characteristic so that the valley and peak regions of the characteristic are raised to the same levels and the slope of the negative resistance region, between the valley and peak regions, is flattened;

bias voltage means for producing a tunnel diode output current and for biasing said diode to operate in the flattened negative resistance region where the output current varies as a fraction of a variation in the bias voltage;

means, responsive to the tunnel diode output current, for isolating the tunnel diode output from load variations and for converting the tunnel diode output to a reference voltage.

5. A tunnel diode voltage reference circuit of claim 4 in which said means for isolating and converting includes a transimpedance amplifier.

6. The tunnel diode voltage reference circuit of claim 5 in which said transimpedance amplifier includes an operational amplifier and a feedback impedance in parallel therewith.

* * * * *